US008712087B2

(12) United States Patent
Ozawa

(10) Patent No.: US 8,712,087 B2
(45) Date of Patent: Apr. 29, 2014

(54) EARPHONE

(75) Inventor: Hiromichi Ozawa, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 80 days.

(21) Appl. No.: 13/321,205

(22) PCT Filed: May 17, 2010

(86) PCT No.: PCT/JP2010/003304
§ 371 (c)(1),
(2), (4) Date: Nov. 18, 2011

(87) PCT Pub. No.: WO2010/134313
PCT Pub. Date: Nov. 25, 2010

(65) Prior Publication Data

US 2012/0076341 A1 Mar. 29, 2012

(30) Foreign Application Priority Data

May 21, 2009 (JP) ..... 2009-123530
May 21, 2009 (JP) ..... 2009-123531

(51) Int. Cl.
*H04R 25/00* (2006.01)

(52) U.S. Cl.
USPC ..... 381/380; 381/328; 181/130

(58) Field of Classification Search
USPC ..... 381/182, 380, 349, 328; 181/130
See application file for complete search history.

(56) References Cited

U.S. PATENT DOCUMENTS

| | | | | | |
|---|---|---|---|---|---|
| 4,742,887 | A * | 5/1988 | Yamagishi | ..... | 181/129 |
| 4,972,492 | A | 11/1990 | Tanaka et al. | | |
| 5,949,896 | A * | 9/1999 | Nageno et al. | ..... | 381/328 |
| 6,084,976 | A * | 7/2000 | Lin | ..... | 381/380 |
| 6,704,429 | B2 * | 3/2004 | Lin | ..... | 381/380 |
| 8,107,665 | B2 * | 1/2012 | Haapapuro et al. | ..... | 381/380 |
| 8,184,821 | B2 * | 5/2012 | Sung | ..... | 381/71.6 |
| 8,340,338 | B2 * | 12/2012 | Mlodzikowski et al. | ..... | 381/380 |
| 2007/0291974 | A1 * | 12/2007 | Eisenbraun | ..... | 381/370 |

FOREIGN PATENT DOCUMENTS

| | | | | | |
|---|---|---|---|---|---|
| EP | 1874080 | A2 | 1/2008 | | |
| GB | 2187361 | A | 9/1987 | | |
| JP | 62-80492 | | 5/1987 | | |
| JP | 2-44899 | | 2/1990 | | |
| JP | H02-44899 | * | 2/1990 | ..... | H04R 1/10 |
| JP | 2643956 | | 5/1997 | | |
| JP | 2000-300599 | | 10/2000 | | |
| JP | 2007-189468 | * | 7/2007 | ..... | H04R 1/10 |

* cited by examiner

*Primary Examiner* — Curtis Kuntz
*Assistant Examiner* — Ryan Robinson
(74) *Attorney, Agent, or Firm* — Whitham Curtis Christoffersofn & Cook, PC

(57) ABSTRACT

The earphone includes a driver unit; a housing accommodating the driver unit, the housing having a front face serving as a sound emitting surface and a bowl shaped rear face; a hollow casing provided separately from the housing, the casing being configured to increase an internal volume adjacent to the rear side of a vibrating plate and to reduce the back pressure of the vibrating plate; and a connecting channel connecting the rear face of the housing and the casing such that the housing is in communication with the internal space of the casing, in which the housing includes a sound emitting tube protruding from the front face thereof so as to be fitted into an external auditory meatus.

10 Claims, 12 Drawing Sheets

EARPHONE

TECHNICAL FIELD

The present invention relates to an earphone used as an acoustic device, and in particular an earphone that includes a driver unit having a vibrating plate with a reduced backpressure and thus improved acoustic characteristics.

BACKGROUND ART

Among traditional earphones used as acoustic devices, an earphone having a hole provided at a portion of a housing thereof and provided with an acoustically resistive member to adjust acoustic characteristics is proposed as an example for improving acoustic characteristics. A typically traditional earphone has a structure shown in FIG. 10. In FIG. 10, a bowl-shaped housing 102 accommodates a driver unit 103 therein and an opening 110 for sound emission at the front face. The driver unit 103 has a yoke 104 into which a disk-shaped magnet 105 is affixed, and a disk pole piece 106 affixed on the magnet 105. The peripheral edge of a vibrating plate 107 is supported by the inner periphery of the housing 102, and the vibrating plate 107 is configured to vibrate at a position facing the pole piece 106. The vibrating plate 107 is composed of a main dome and a surrounding subdome, and one end of a voice coil 108 is affixed along the boundary of the main dome and the surrounding subdome. The voice coil 108 is positioned in a magnetic gap between the periphery of the pole piece 106 and the inner periphery of the yoke 104.

The input of sound signals to the voice coil 108 allows the voice coil 108 to vibrate together with the vibrating plate 107 by the action of the electromagnetic force of the sound signals and the magnetic field in the magnetic gap, leading to outputting sound. A hole 109 is provided at the rear side of the housing 102, and the hole 109 is provided with an acoustically resistive member 111 on the inner face of the housing 102. The hole 109 is provided to expand the reproducible low-frequency range by relieving the pressure applied on the rear face of the vibrating plate 107 during vibration thereof, and the acoustically resistive member 111 is provided to adjust acoustic characteristics.

Furthermore, as shown in FIG. 11, a known earphone is provided with a bass compensating pipe 112 attached as a means of extending the lower-limit frequency. Its basic configuration is similar to the example shown in FIG. 10, in which the bass compensating pipe 112, having a given length and diameter, is integrated with the housing 102 having the driver unit 103 and is in communication with the internal space of the housing 102. Thus the lower-limit frequency in the vibrating plate can be expanded by the action of the space of the bass compensating pipe 112. Unfortunately, such a configuration shown in FIG. 11 restricts the shape and thickness of the driver unit 103, and thus the expansion of the internal volume of the bass compensating pipe 112, imposing limitations on improved acoustic characteristics, especially of the bass range.

Accordingly, an earphone shown in FIG. 12 is proposed. The earphone shown in FIG. 10 to FIG. 12 is disclosed in Patent Literature 1. In FIG. 12, a first housing 201 and a second housing 202 are provided, and the housings 201 and 202 communicate with each other via a communication channel 203. The first housing 201 is provided with the driver unit 103 similar to that described in FIGS. 10 and 11. A vibrating plate 204 for bass compensation is disposed in the internal space of the second housing 202. According to the description of Patent Literature 1, such a configuration achieves an earphone which has improved acoustic characteristics of the low-frequency range without any influence on those of medium to high audio frequency range.

The invention disclosed in Patent Literature 1, as shown in FIG. 12, is intended to resonate the vibrating plate 204 for bass compensation provided in the second housing 202 with the vibrating plate of the driver unit 103 so as to expand the reproducible frequency range to the lower audio frequency. Unfortunately, the drive energy from the earphone driver is essentially so small that it is impractical for the vibrating plate 204 for bass compensation to be resonated by a vibration caused by the vibrating plate of the driver unit. Even if the vibrating plate 204 for the bass compensation can be resonated, only the resonant frequency range is emphasized, so that well-balanced sound cannot be reproduced over the entire frequency range, or otherwise the driver needs to be driven at such large power as may harm an ear of a user. Furthermore, the vibrating plate 204 for the bass compensation provided inside the second housing 202 is a factor of high production costs.

CITATION LIST

Patent Literature

Patent Literature 1: Japanese Patent Gazette No. 2643956

SUMMARY OF INVENTION

Technical Problem

An object of the present invention is to solve the above-mentioned problems observed in conventional earphones, and provide an earphone having effectively improved acoustic characteristics, especially in the low frequency range, without a vibrating plate for bass compensation which is a factor to impose additional cost. Another object of the present invention is to provide an earphone which is less likely to fall out of the ear of a user and is more comfortably fit in the ear even if a large casing is used to improve acoustic characteristics in the low frequency range

Solution to Problem

An earphone according to the present invention, includes: a driver unit; a housing accommodating the driver unit, the housing having a front face serving as a sound emitting surface and a bowl-shaped rear face; a hollow casing provided separately from the housing, the casing being configured to increase an internal volume adjacent to the rear side of a vibrating plate of the driver unit and to reduce the back pressure of the vibrating plate; and a connecting channel connecting the rear face of the housing and the casing such that the housing is in communication with the internal space of the casing, in which the housing includes a sound emitting tube protruding from the front face thereof so as to be fitted into an external auditory meatus.

Another embodiment of the invention is characterized in that the connecting channel extends diagonally upwards from a tilted portion of a rear face of the housing such that the casing is positioned diagonally upwards from the housing. Further another embodiment of the invention is characterized in that the housing is configured to be urged to a cavity defined by a tragus, anti-tragus, and ear concha of a user.

Advantageous Effects of Invention

The earphone according to the present invention is provided with the hollow casing separately from the housing which accommodates the driver unit such that the internal space of the casing and the rear side of the housing communicate through the connecting channel, allowing the space adjacent the rear side of the vibrating plate to expand and reduce the pressure on the rear side during vibration. As a result, the vibrating plate can vibrate faithfully according to input sound signals, and the fidelity of the vibration in the bass range caused by large back pressure is significantly improved, leading to the expansion of the reproducible area in the bass range.

A possible countermeasure to expand the reproducible low-frequency range is to provide a hole enabling the space adjacent the rear side of the vibrating plate to communicate with the outer space, like conventional embodiments shown in FIGS. 10 and 11; however, noise leaking through the hole makes it an unfavorable approach.

The earphone according to the present invention, which is provided with a hollow casing separately from the housing, can reproduce the lower frequency range in a balanced manner. Expansion of the internal space by enlarging the casing enables further lower frequencies to be reproduced. Accordingly, it is preferred that the casing be as large as possible. An earphone provided with a large casing is more likely to fall out of the ear of the user because of its unbalanced weight.

Regarding this, according to another embodiment of the invention, since the casing is configured to be positioned diagonally upwards from the housing in use, the force to turn the housing by the load applied to the casing is too weak to cause the earphone to fall out of the ear of the user. Furthermore, according to another embodiment of the invention, the housing is configured to be urged to the cavity defined by a tragus, anti-tragus, and ear concha of the user, resulting in the housing in use advantageously maintained more stable.

DESCRIPTION OF EMBODIMENTS

Figure 1:
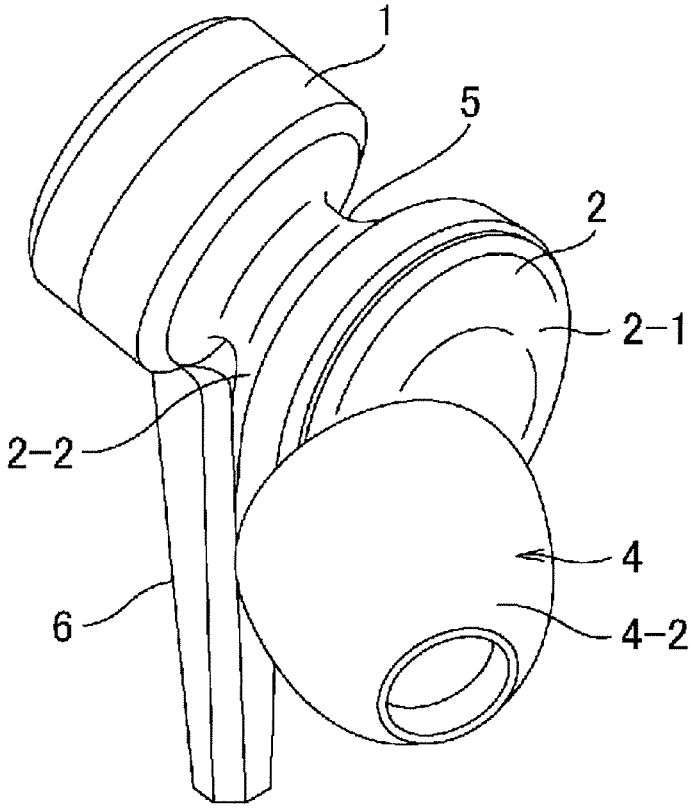
FIG. 1 is a perspective view of an earphone according to an embodiment of the present invention.

An earphone according to an embodiment of the present invention will be described with reference to the following drawings.

In FIGS. 1 to 4, the earphone includes the following major components: a housing 2, a casing 1, a connecting channel 5 connecting the housing 2 and the casing 1 integrally, a sound emitting tube 3, and an ear piece 4. The housing 2 is originally hollow and accommodates a driver unit (not shown) inside of the hollow portion. The housing 2 comprises a bowl-shaped rear face 2-2 and a planar circular front face 2-1. The casing 1 is a hollow member different from the housing 2 and has a cylindrical shape with its both end faces closed. The term "hollow" refers to the state being "empty in the interior" that accommodates no movable member such as a vibrating plate for bass compensation. The connecting channel 5 has a cylindrical shape and connects the rear face 2-2 of the housing 2 and the one end face of the casing 1 such that the housing 2 is in communication with the internal space of the casing 1.

Figure 4:
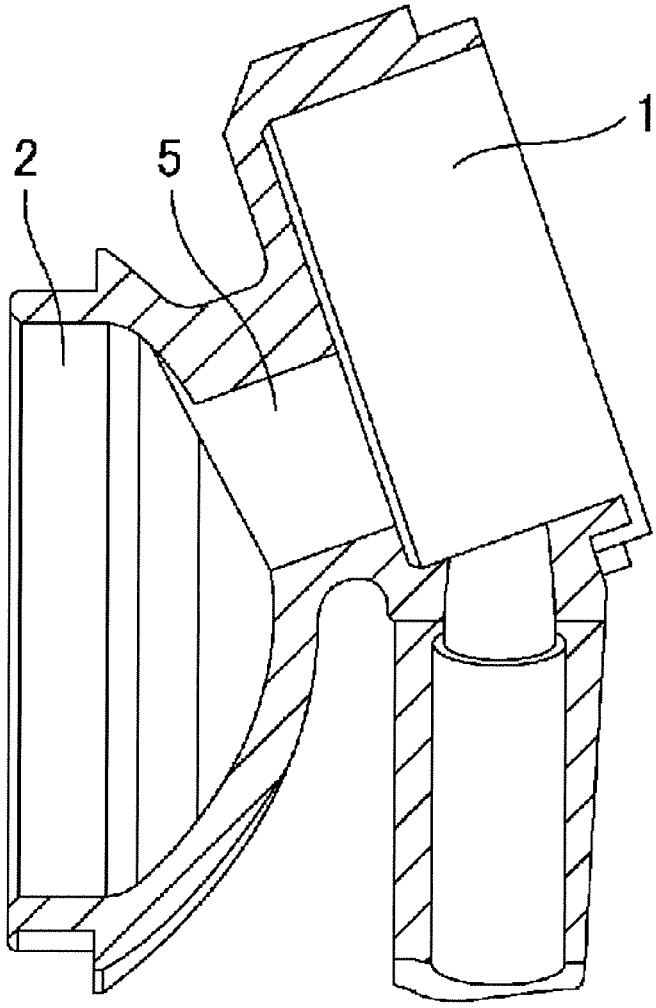
FIG. 4 is a longitudinal cross-sectional view of parts which form a housing, a casing, and a connecting channel in the embodiment.
Figure 7:
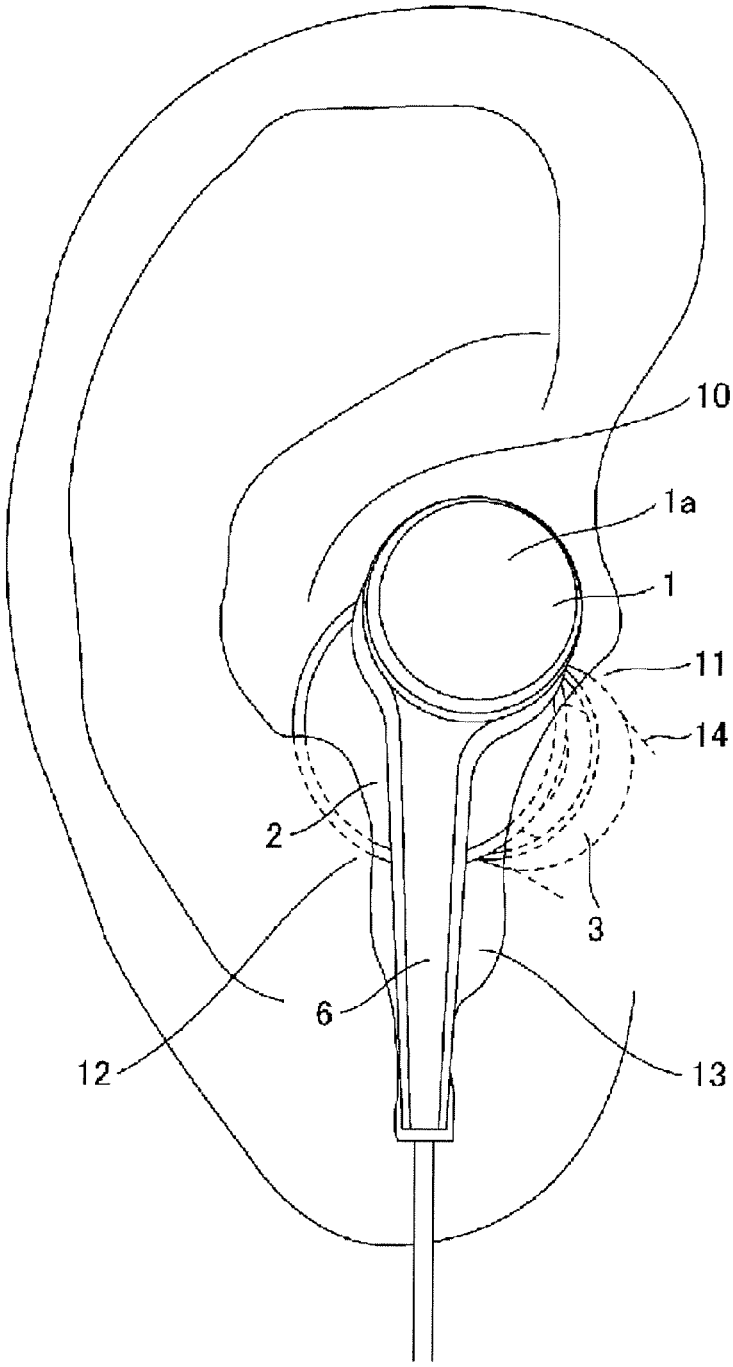
FIG. 7 is a perspective view illustrating the earphone as applied to a user according to the embodiment.

A lead drawing portion 6 protrudes from the casing 1 like a cantilever. The housing 2 is provided with the sound emitting tube 3 that protrudes from the front face 2-1 towards the external auditory meatus 14 of the user in use, as shown in FIG. 7. The ear piece 4 is fitted to the peripheral edge of the sound emitting 3. In the illustrative embodiment, as shown in FIG. 4, the casing 1, the connecting channel 5, the housing 2, and the sound emitting tube 3 are integrated into one piece with, for example, a resin, but all or parts of these components may be prepared as discrete components so as to be finally assembled into an integrated piece. In FIG. 4, the one end of the casing 1 is open, but this open end is to be covered with a cap.

Figure 2:
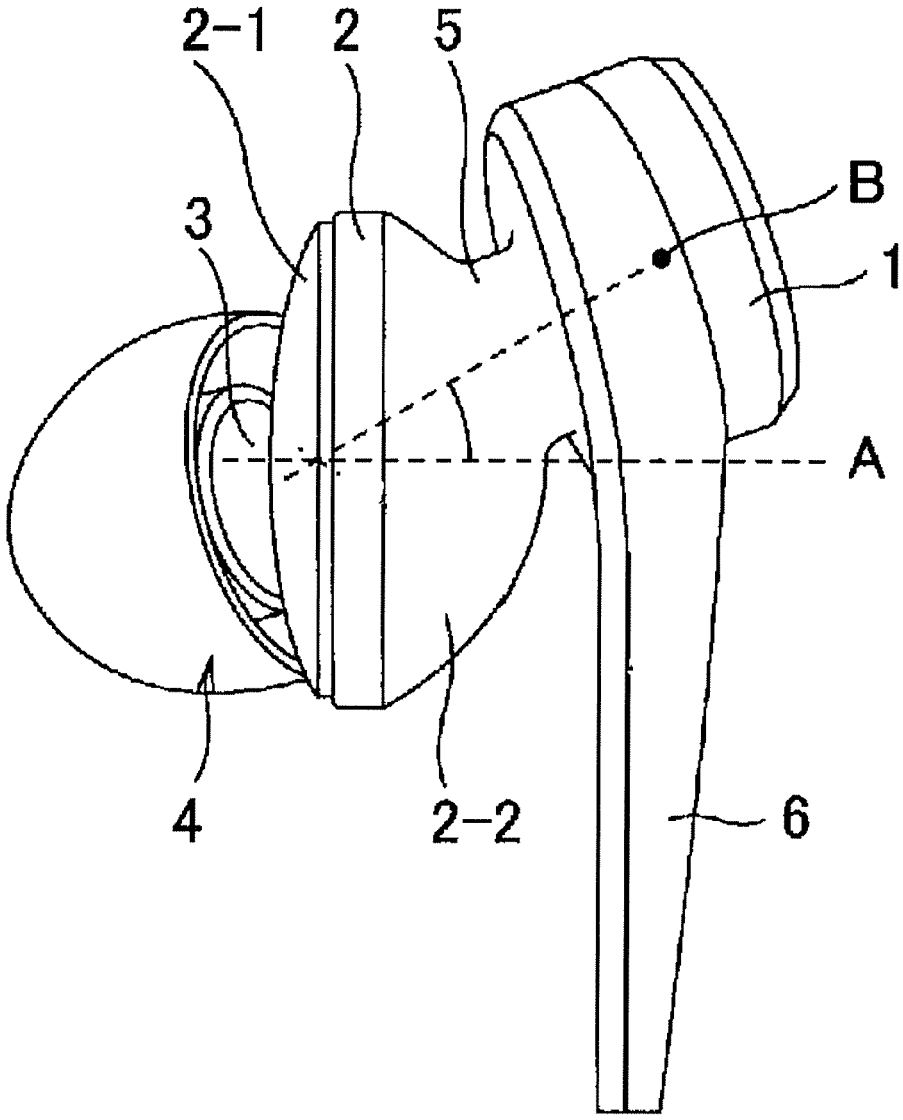
FIG. 2 is a right side view of the earphone according to the embodiment of the present invention.

In FIG. 2 according to an embodiment of the casing 1 in use, being fitted into the ear of the user, the connecting channel 5 is connected to the rear face 2-2 of the housing 2 such that the casing 1 is positioned diagonally upwards from the housing 2. More specifically, one end of the connecting channel 5 is connected to the tilted face at a portion, located to the side of the head of the user, of a bowl-shaped rear face 2-2 of the housing 2 while the other end of the connecting channel 5 is connected to the casing 1. The connecting channel 5 extends in a direction substantially perpendicular to a tangent line of the tilted face of the housing 2 positioned adjacent the head of the user such that the casing 1 is positioned, as described above, diagonally upwards from the housing 2 in use.

Figure 3:
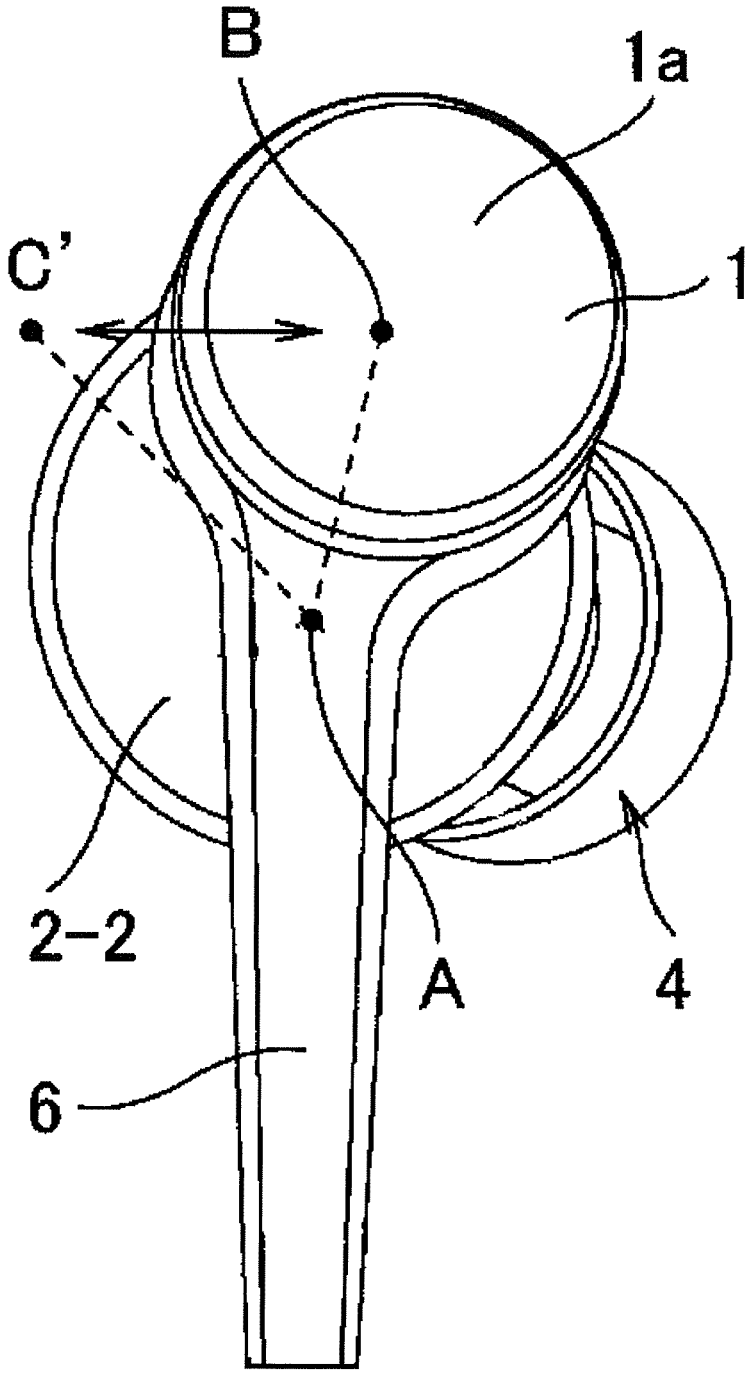
FIG. 3 is a back view of the earphone according to the embodiment of the present invention.

Regarding the position of the casing 1, the center B of the casing 1 needs to be shifted upwards relative to the line A which extends from the center of the rear face 2-2 to that of the front face 2-1 of the housing 2. Furthermore, regarding the position of the casing 1, as shown in FIG. 3, the center B of the casing 1 may be shifted to the front or to the back (e.g. transferred to C') relative to the line A which extends from the center of the rear face 2-2 to that of the front face 2-1 of the housing. The casing 1 may have a structure that can rotate around the line A to shift continuously in the range of the position B to the position C'. In this case, the casing 1 can rotate around the line A, for example, in the case where the rear face 2-2 can rotate relative to the front face 2-1 by providing the front face 2-1 of the housing as a separate part from the housing main body and fitting into the housing main body. In any case, the shifted position of the casing 1 from the housing 2 in use can reduce the rotational moment created by the load of the casing 1 about the fulcrum which is the housing 2 fitted into the ear of the user, leading to the effect that the earphone is less likely to fall out of the ear. As is apparent from FIG. 2, while any connecting position of the connecting channel 5 can be chosen, the casing 1 positioned diagonally upwards from the housing 2 can enhance the fitting comfort to the ear of the user.

The expansion of the internal volume adjacent to the rear side of a vibrating plate of the driver unit including the internal volume of the casing 1 allows the reproducible frequency range to expand to the lower audio frequencies, and thus the reproducible frequency range expands to the lower audio frequencies with an increase in the internal volume of the casing 1. Unfortunately, an increase in the size of the casing 1 to increase the internal volume of the casing 1 increases the rotational moment created by the load of the casing 1 about the fulcrum which is the housing 2 in the earphone in use, leading to instability. In the earphone according to the embodiment, for solving this problem, the casing 1 is devised to be shifted diagonally upwards from the housing 2 to reduce the rotation moment, leading to further expansion of the internal volume of the casing 1. In the earphone according to the embodiment, the casing 1 allows the earphone in use to protrude from the auricle of the user so as not to contact with the auricle of the user even if the volume of the casing 1 is expanded.

Figure 10:
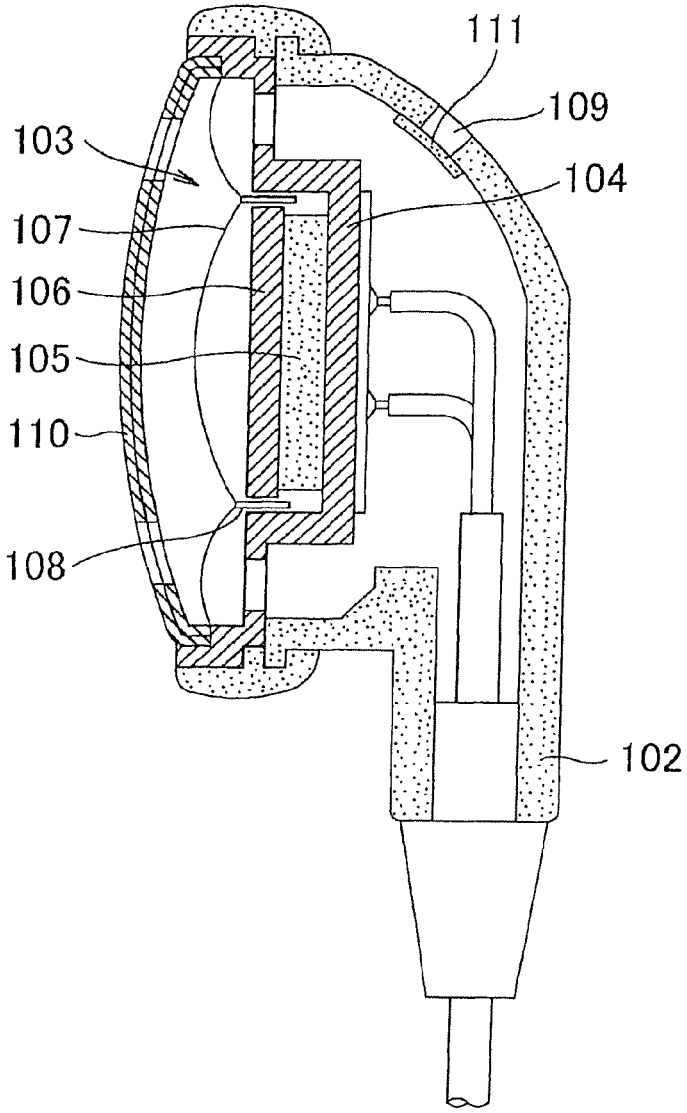
FIG. 10 PRIOR ART
FIG. 10 is a longitudinal cross-sectional view of a typical conventional earphone.
Figure 11:
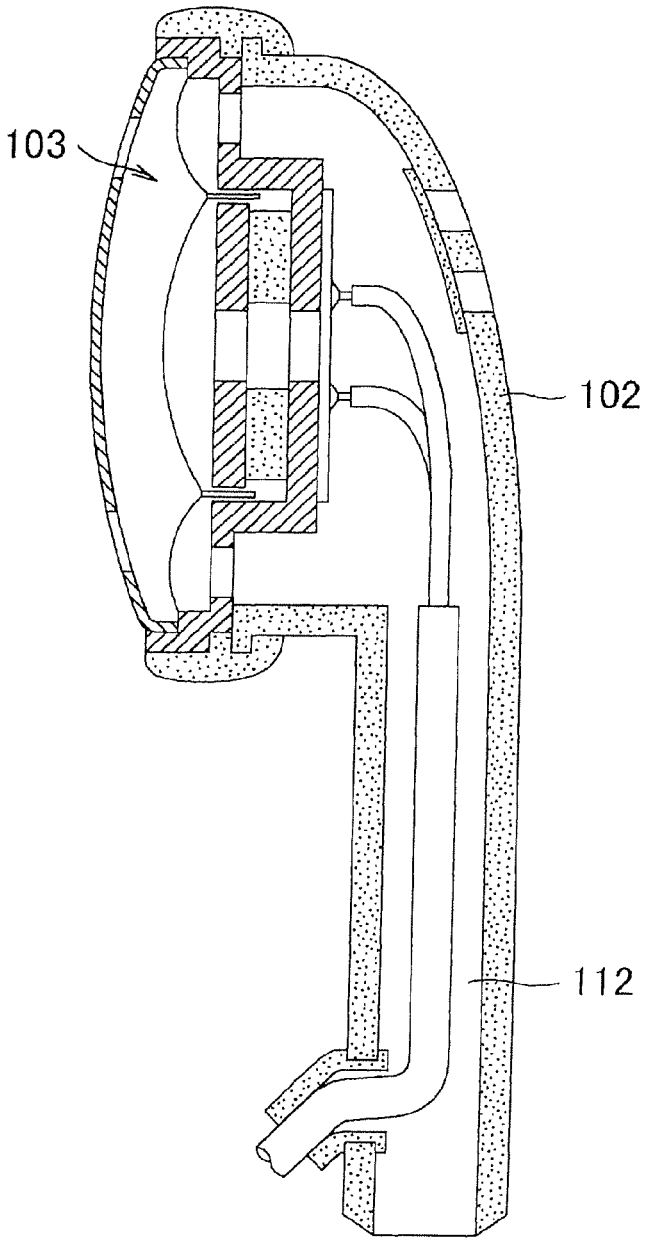
FIG. 11 PRIOR ART
FIG. 11 is a longitudinal cross-sectional view of another conventional earphone.
Figure 12:
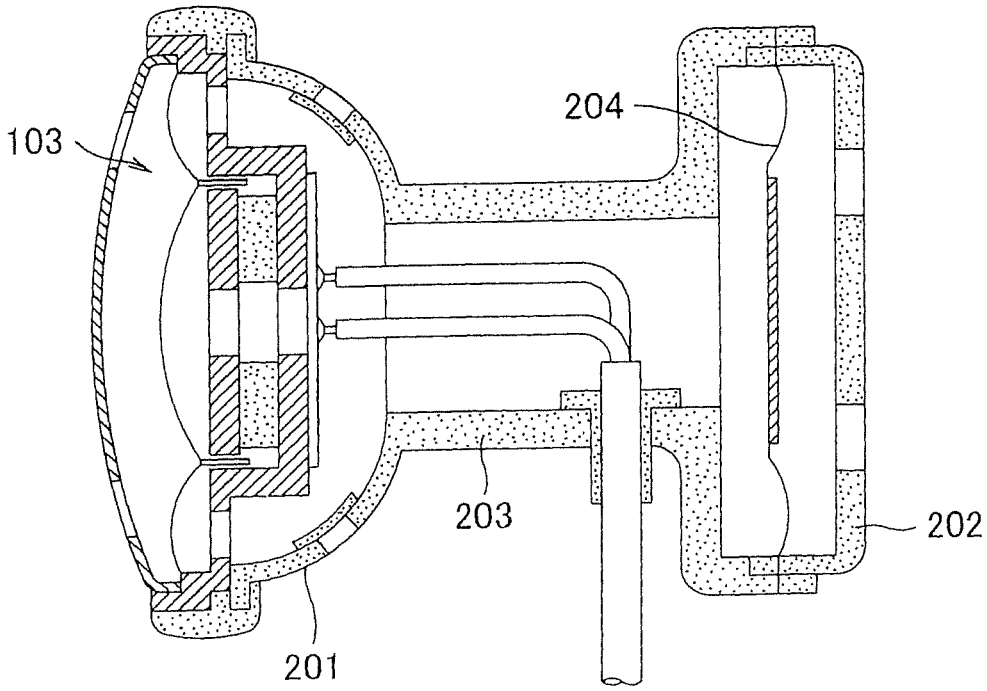
FIG. 12 PRIOR ART
FIG. 12 is a longitudinal cross-sectional view of still another conventional earphone.

The driver unit (not shown) can have any configuration, and, for example, such a driver unit may have a substantially identical configuration to that of the conventional driver unit 103 exemplified in FIG. 10. The casing 1 and the connecting channel 5 also each have any shape, and rounded shapes such as a cylindrical shape are preferred in view of the fitting comfort to the user.

In FIG. 2, the casing 1 is provided with a lead drawing portion 6. The lead drawing portion 6 protrudes from the lower periphery of the casing 1 towards the intertragic notch of the auricle of the user like a rod so as to fit into the intertragic notch in use of the earphone. The lead drawing portion 6 has a hollow inner portion from which a lead wire (not shown) is extracted to the outside while sound signals are input from the outside. The lead drawing portion 6 can have any lengthwise dimension, and preferably should be long and flexible as much as possible to prevent the lead wire from being damaged. The illustrated embodiment assumes that the earphone is applied to the right ear of the user. The earphone applied to the left ear has a mirror image of the illustrated embodiment. A combination of right and left earphones electrically conducted with each other in any appropriate manner such as a lead wire to input sound signals can form a typical stereophonic earphone set.

In FIG. 3, the end face, remote from a connecting channel 5, of the casing 1 is a decorative surface 1*a* having a circular plan view, which can be provided with a design picture or carving. The casing 1 is connected to the rear face 2-2 of the housing 2 via the connecting channel 5 such that the decorative surface 1*a* on the earphone in use is parallel to a sagittal plane for a user or a plane dividing the front view of the human body into symmetric right and left sections. Thus, the decorative surface 1*a* can be readily noticed by human eyes and the advertisement effect is expected to increase if a design picture, carving or trademark is provided on the decorative surface 1*a*. The decorative surface 1*a* can have any appropriate shape, for example, such as a circular, square, diamond, polygonal, or oblong shape.

The bowl-shaped rear face 2-2 of the housing 2 in use is joined to the internal (rear) face of a tragus 11 and the internal (rear) face of an anti-tragus 12 of a user illustrated in FIG. 7, the front face 2-1 of the housing 2 is joined to an ear concha 13 illustrated in FIG. 7, and the housing 2 is urged by the tragus 11, anti-tragus 12, and ear concha 13 of the user. Thus, the housing 2 can be fit to the auricle cavity defined by the internal faces of the tragus 11, anti-tragus 12, and ear concha 13 of the user, and the elasticity of the auricle can prevent detachment of the housing 2.

As shown in FIG. 2, the housing 2 includes the sound emitting tube 3 that protrudes from the front face 2-1 towards the external auditory meatus 14 of the user shown in FIG. 7. The ear piece 4 is fitted to the sound emitting tube 3. The ear piece 4 is composed of the cylindrical portion fitting to the periphery of the sound emitting tube 3 and the flexible hemispherical portion formed by folding back the cylindrical portion from its end. The flexible portion of the ear piece 4 comes into tight contact with the inner periphery of the ear canal of the user. Such a configuration allows the ear piece 4 and the housing 2 to easily fit to the ear auricle of the user, enhancing the fitting comfort. Furthermore, the casing 1 secures a sufficiently large internal volume including the housing 2, leading to no need for providing a hole to the housing 2 for improving acoustic characteristics, especially of the bass range, thus resulting in reductions in processing time, and costs for acoustic resistive members.

As shown in FIG. 4, the housing 2 accommodating a driver unit (not shown) therein are in communication with the internal space of the casing 1 via the connecting channel 5. The casing 1 has a hollow internal structure, and the housing 2 and the casing 1, positioned as described above, can increase or decrease the size of the hollow portion of the casing 1 adequately to adjust acoustic characteristics. Since the acoustic characteristics does not depend on the size or the shape of the housing 2 which determines the fitting comfort of an earphone, the acoustic characteristics can be adjusted without impairing the fitting comfort.

The connecting channel 5 can have any length. A short length is preferred, because a significantly long connecting channel may cause the casing 1 to protrude from the housing 2, leading to increased rotational moment in use of the earphone, resulting in imbalance. Thus, the earphone according to the illustrated embodiment has a large internal volume due to communication between the hollow portion of the casing 1, the cavity of the connecting channel 5, and the cavity of the housing 2, leading to reduced backpressure and thus improved acoustic characteristics, especially in the bass range to the middle range. The sound quality can also be maintained at a high range. The internal spaces of the casing 1, connecting channel 5, and housing 2 may have any appropriate shape that contributes to improved acoustic characteristics, besides the illustrated shapes.

Figure 5:
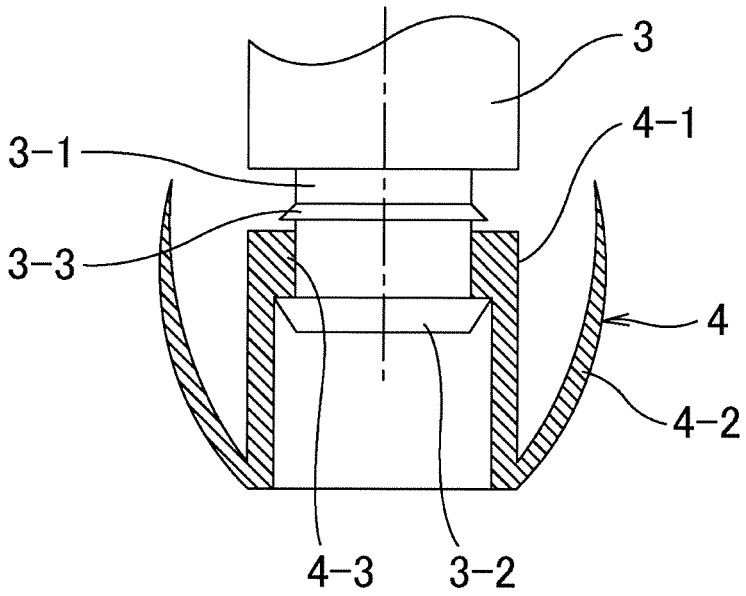
FIG. 5 is a longitudinal cross-sectional view of parts of a sound emitting tube and an ear piece of the earphone according to the embodiment of the present invention.

In FIG. 5, an ear piece 4 is made of pliable material such as silicone to fit to the ear canal of the user and comprises a cylindrical basal portion 4-1 for fitting to the periphery of the sound emitting tube 3 and a fitting portion 4-2 for the ear canal integrated with the basal portion 4-1 by folding back the peripheral edge of the basal portion 4-1. The fitting portion 4-2 has a hollow hemispherical shape (hemisphere) divided along a radial plane. The basal portion 4-1 of the ear piece 4 has a central hole in the direction of sound dissipation, and the diameter of the inner-periphery of the rear end portion of the basal portion 4-1 is small. This small diameter portion serves as a fitting portion 4-3 for the sound emitting tube 3.

The peripheral edge of the sound emitting tube 3 has a small diameter and serves as a fitting portion 3-1 for the ear piece 4. The fitting portion 3-1 is provided with two protrusions 3-2 and 3-3 along its periphery at a predetermined distance in the direction of the central axis of the fitting portion 3-1. The distance between protrusions 3-2 and 3-3 is substantially the same as or slightly longer than the size of the fitting portion 4-3 of the ear piece 4 in the direction of the central axis. The protrusions 3-2 and 3-3 each include a first plane which is perpendicular to the central axis at a cross-sectional plane containing the central axis of the sound emitting tube 3 and a second plane which intersects the first plane and tilts relative to the central axis. The first planes, perpendicular to the central axis, of the protrusions 3-2 and 3-3 face each other, and the second planes tilting relative to the central axis extend from the first planes.

Figure 6:
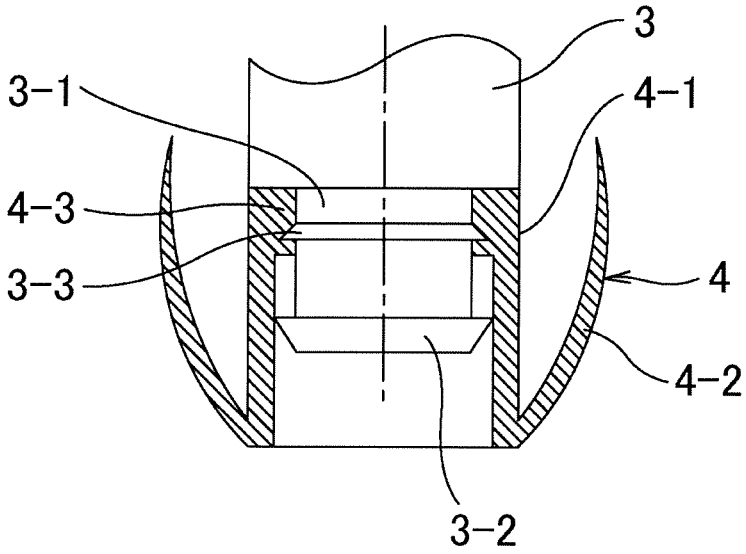
FIG. 6 is a longitudinal cross-sectional view illustrating a different relative position between the emitting tube and the ear piece.

In the embodiment shown in FIG. 5, the fitting portion 4-3 of the ear piece 4 is fit between the protrusions 3-2 and 3-3, and the ear piece 4 projects relatively far from the sound emitting tube 3. In an embodiment shown in FIG. 6, a portion of the fitting portion 4-3 of the ear piece 4 is positioned over the protrusion 3-3, and the rear end of the ear piece 4 abuts a step of the rear end of the fitting portion 3-1 of the sound emitting tube 3, leading to the retraction of the ear piece 4. At the retracted position of the ear piece 4, the protrusion 3-3 bites into the fitting portion 4-3 of the flexible ear piece 4 so as to maintain the retracted position of the ear piece 4. A user can select whether the ear piece 4 is allowed to project significantly as shown in FIG. 5 or to be retracted as shown in FIG. 6 depending on his/her preference. Thus, the position of the ear piece 4 can be adjusted between two settings. An increased number of protrusions may be provided on the fitting portion 3-1 of the sound emitting tube 3 to increase the number of steps for adjusting the degree of the projection of the ear piece 4.

As shown in FIG. 7, fitting an earphone according to the embodiment to the ear auricle of a user allows the bowl-shaped rear face 2-2 of the housing 2 to be joined to the internal face of the tragus 11 and the internal face of the anti-tragus 12 of the user and the front face 2-1 of the housing 2 to be joined to the ear concha 13, as described above. The housing 2 is urged by the internal faces of the tragus 11, anti-tragus 12, and ear concha 13 of the user. The casing 1 is connected to the rear face of the housing 2 via a connecting channel 5 such that the decorative surface 1*a* is parallel to a sagittal plane (a plane which virtually divides the front view of the human body into symmetric right and left sections) for the user. Accordingly, the decorative surface 1*a* can be seen readily from the outside. The tight contact of the front face 2-1 of the housing 2 with the ear concha 13 has an effect to provide a sense of ease such as being comfortably fitted to the user.

The rodlike lead drawing portion 6 like a cantilever, which is positioned to fit into the intertragic notch of the ear auricle of the user, protrudes from the casing 1 to conform to the shape of the ear auricle. Furthermore, an earpiece 4 is fitted to the sound emitting tube 3 that protrudes from the front face 2-1 of the housing 2 towards the external auditory meatus 14 of the user and the earpiece 4 is to be inserted into the external auditory meatus 14 of the user. Earphones according to illustrated embodiments have shapes conforming to the ear auricle of ordinary persons to enhance the fitting comfort for users, being less likely to fall out when used. Furthermore, the ear piece 4 conforms to the ear auricle to facilitate an intimate contact so as to reduce sound leaking.

Figure 8:
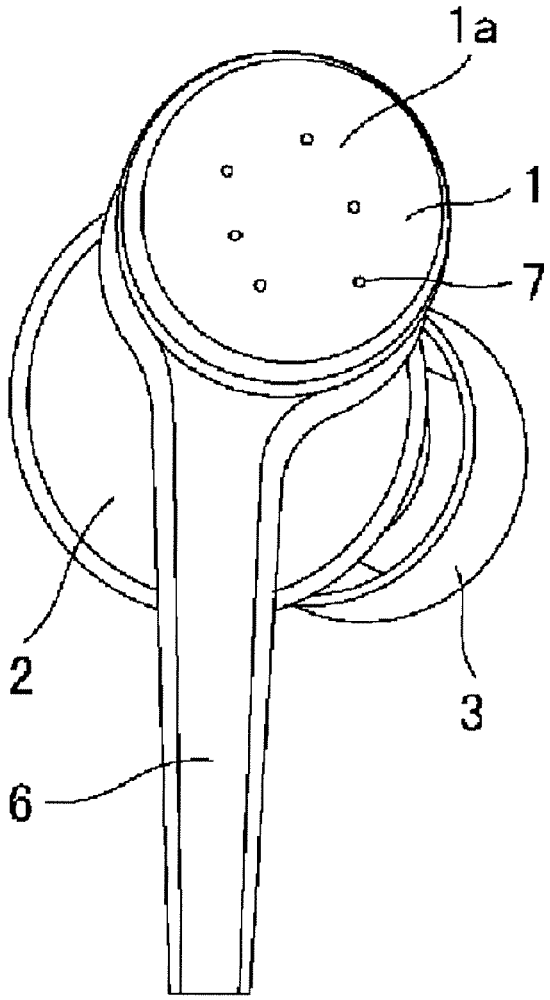
FIG. 8 is a back view of an earphone according to another embodiment of the present invention.

At least one of the housing 2, the connecting channel 5, and the casing 1 may be provided with at least one acoustic controlling hole 7. As shown in an embodiment in FIG. 8, in the case of an acoustic controlling hole 7 having a decorative surface 1*a*, a decoration or trademark provided on the decorative surface 1*a* can make the acoustic controlling hole 7 less noticeable. The acoustic controlling hole 7 further may have at least one acoustic resistive member attached thereto (not shown). The number and the positions of the acoustic controlling holes 7 and the number of acoustic resistive members can be appropriately selected depending on the desired acoustic characteristics.

Figure 9:
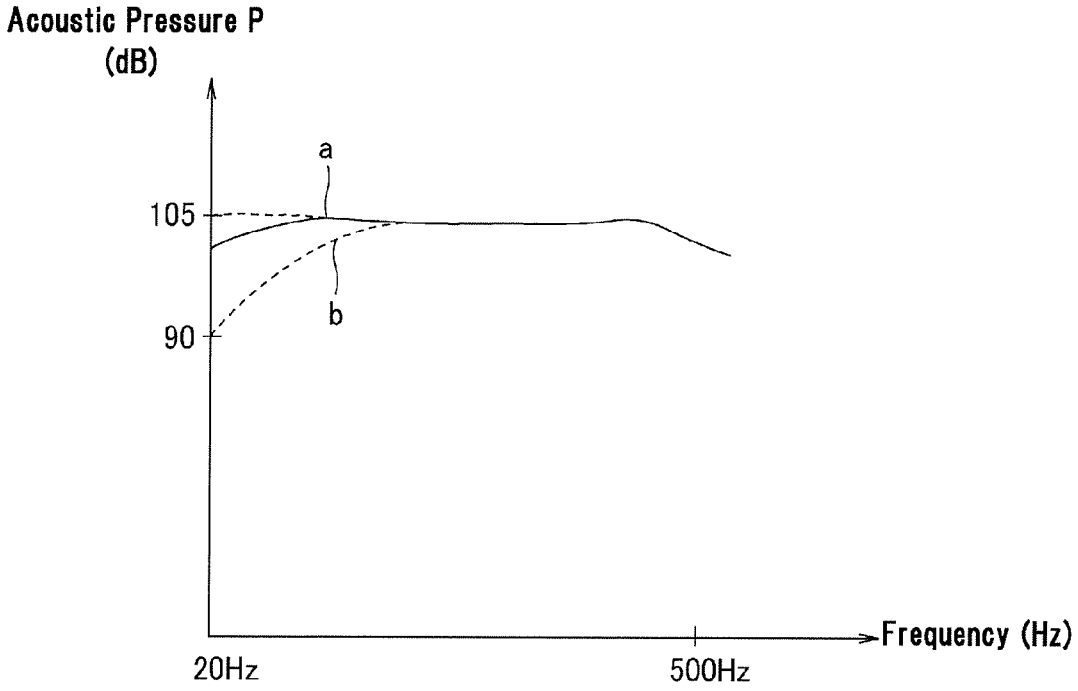
FIG. 9 is a graph illustrating the observed frequency response of an earphone according to the present invention in comparison with a conventional one.

FIG. 9 is a graph showing the results of the observed frequency and acoustic pressure within an artificial ear coupler at an input of 1 mW applied to a conventional earphone in FIG. 10 and the earphone in FIG. 1 according to the embodiment of the present invention. The solid line a indicates the measured values of the earphone according to the embodiment of the present invention, while the dotted line b indicates the measured values of the conventional earphone. The measurement was carried out in accordance with an EIAJ (Electronics Industry Association of Japan) standard: RC-7502A. The internal shape of the artificial ear coupler was equivalent to B & K 4157 in the EIAJ (Electronics Industry Association of Japan) standard. The results in FIG. 9 demonstrate that the earphone according to the embodiment of the present invention surpasses a conventional earphone in acoustic characteristics in the bass to middle range.

INDUSTRIAL APPLICABILITY

The present invention can expand the reproducible frequency range to lower audio frequencies, leading to comfortable reproduced sound capable of clearly reproducing deep bass. Accordingly, the demand for earbud style earphones can be expected to be expanded.

REFERENCE SIGNS LIST

1 casing
1*a* decorative surface
2 housing
2-1 front face of housing
2-2 rear face of housing
3 sound emitting tube
4 ear piece
4-1 basal portion
5 connecting channel
6 lead drawing portion
7 acoustic controlling hole
11 tragus
12 anti-tragus
13 ear concha
14. external auditory meatus

The invention claimed is:

1. An earphone comprising:

a driver unit;

a housing accommodating the driver unit, the housing having a front face serving as a sound emitting surface and a bowl-shaped rear face;

a hollow casing provided separately from the housing, the casing being configured to increase an internal volume adjacent to the rear side of a vibrating plate of the driver unit and to reduce the back pressure of the vibrating plate; and a connecting channel connecting the rear face of the housing and the casing such that the housing is in communication with the internal space of the casing, wherein the housing includes a sound emitting tube protruding from the front face thereof so as to be fitted into an external auditory meatus, and wherein the sound emitting tube is configured to fit to an ear piece such that the relative position between the sound emitting tube and the ear piece is adjustable.

2. The earphone according to claim 1, wherein the connecting channel extends diagonally upwards from a tilted portion of a rear face of the housing such that the casing is positioned diagonally upwards from the housing in use.

3. The earphone according to claim 1, wherein the housing is configured to be urged to a cavity defined by a tragus, anti-tragus, and ear concha of a user.

4. The earphone according to claim 1, wherein the bowl-shaped rear face of the housing is joined to the internal face of the tragus and the internal face of the anti-tragus of the user.

5. The earphone according to claim 1 wherein the front face of the housing is joined to the ear concha.

6. The earphone according to claim 1, wherein the casing includes a lead drawing portion for extracting a lead, the lead drawing portion extending along an intertragic notch of the user.

7. The earphone according to claim 1, wherein a surface of the casing remote from the connecting channel serves as a decorative surface, the casing being connected to the housing via the connecting channel such that the decorative surface in use is parallel to a sagittal plane for the user.

8. The earphone according to claim 1, wherein the position of the ear piece is adjustable back and forth along the sound emitting tube.

9. The earphone according to claim 1, wherein at least one of the housing, the connecting channel, and the casing has at least one acoustic controlling hole.

10. The earphone according to claim 9, wherein the acoustic controlling hole has an acoustic resistive member attached thereto.

* * * * *